United States Patent [19]

Stewart

[11] Patent Number: 4,564,193

[45] Date of Patent: Jan. 14, 1986

[54] EXERCISING DEVICE FOR LIFTING WEIGHTS

[76] Inventor: Lester Stewart, 6851 E. Paradise Pkwy., Scottsdale, Ariz. 85251

[21] Appl. No.: 560,755

[22] Filed: Dec. 12, 1983

[51] Int. Cl.[4] ..... A63B 21/06

[52] U.S. Cl. ..... 272/118; 272/65; 272/73; 272/144; 272/119

[58] Field of Search ..... 272/118, 65, 93, 73, 272/134, 144, 900, DIG. 4, 119

[56] References Cited

U.S. PATENT DOCUMENTS

| | | | |
|---|---|---|---|
| 2,855,200 | 10/1958 | Blickman | 272/73 X |
| 3,501,141 | 3/1970 | Nissan et al. | 272/65 |
| 4,316,609 | 2/1982 | Silberman | 272/118 |
| 4,477,070 | 10/1984 | Applebaum | 272/65 X |

*Primary Examiner*—Richard J. Apley
*Assistant Examiner*—William R. Browne
*Attorney, Agent, or Firm*—Gregory J. Nelson

[57] ABSTRACT

An exercise apparatus having a frame which includes frame members joined by detachable couplings for adjustability and a cable system having a take-up reel and one or more cable reels around which the cable can be trained are attached to the frame by detachable couplings. A weight carrier is attached to the cable system so pre-selected weights can be placed on the carrier to impose a resistance force to movement of the cable by the user. Auxiliary devices such as a bicycle apparatus and weight bench are also constructed using the detachable couplings and may be utilized with the said exercise device.

10 Claims, 13 Drawing Figures

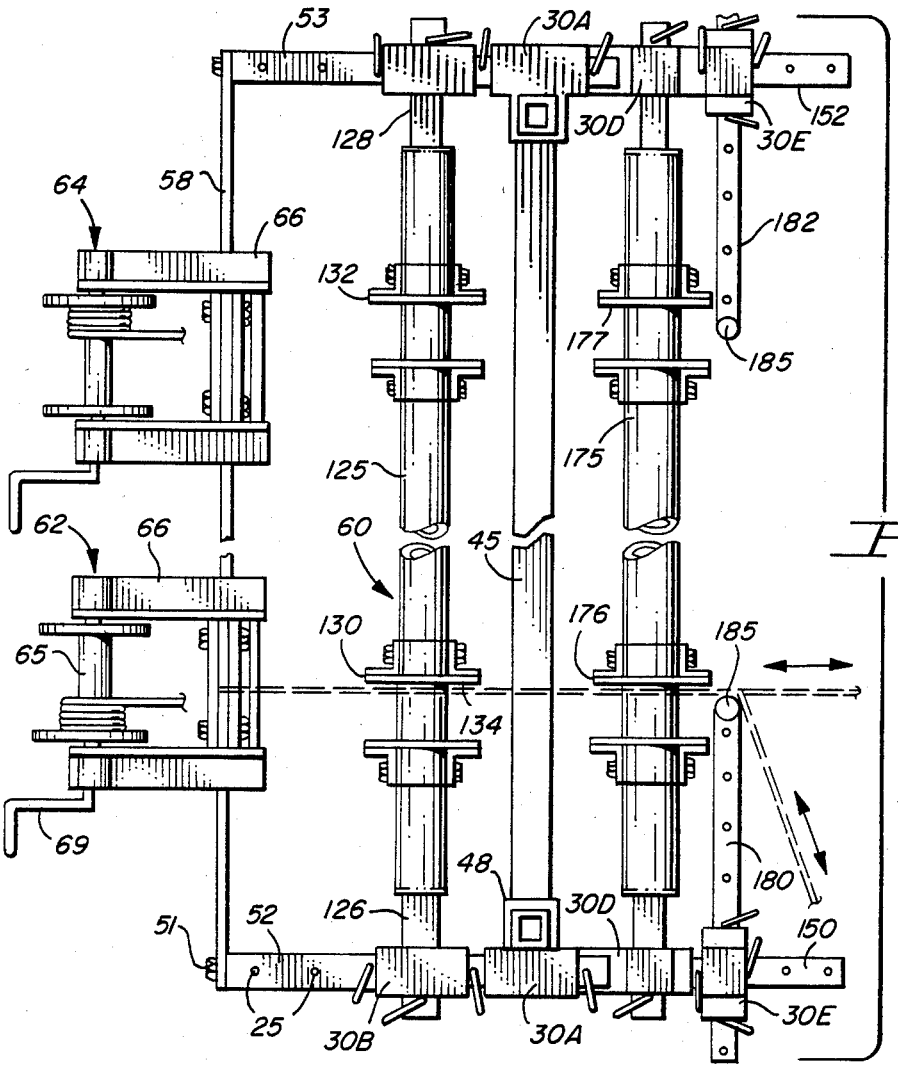
FIG. 8
FIG. 9
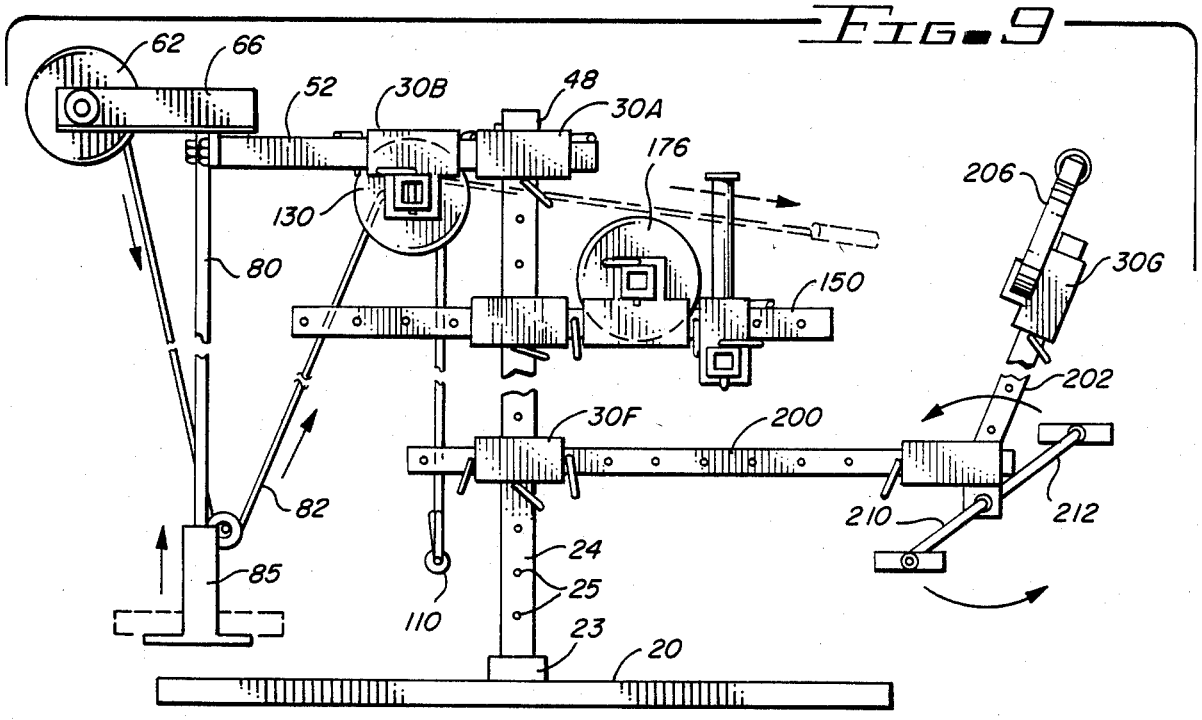

EXERCISING DEVICE FOR LIFTING WEIGHTS

The present invention relates to exercising devices and more particularly relates to a universal and highly versatile exercise for developing and conditioning various parts of the body.

The importance of regular exercise for building and maintaining strength as well as for health and endurance is widely recognized. The sedentary lifestyle of contemporary society is often at the expense of physical fitness. Accordingly, in recent years, there has been an increased awareness of the benefits of exercise and an attendant interest in various exercise programs. Aerobic exercises such as dancing, running, jogging, swimming and bicycling which serve to develop and strengthen the cardiovascular system have become increasingly popular. However, other forms of exercise are necessary for increasing muscular strength and endurance. One of the best ways of developing muscular strength and endurance is through weight training.

The simplest and least expensive device for weight training is the bar bell with removable weights. However, bar bells have certain disadvantages in that they are sometimes difficult to use often requiring the assistance of another person. Beyond that, bar bells are not effective to develop all parts of the musculature of the body. Further, weights of this type are inconvenient in that they are difficult to store and require a great deal of time and effort to change weights for the various exercises.

Various other devices and apparatus have been developed for comprehensive conditioning programs. Devices of this type generally provide the user with a resistance against which muscular effort must be applied. The resistance typically is provided by means of weights, shock absorbers, springs, cams and other devices. These devices permit resistance force to be developed so that the user can engage in a number of different exercises. Some complex machines of this type are built as a unit and are usable by a number of persons at one time. Some of these machines employ weights which are lifted during operation and which provide substantially constant tension mechanisms for resisting movement of selected muscles and thus are isotonic over a predetermined range of operation. Other machines can vary the tension and selected range of operation and are isokinetic such as those using hydraulic cylinders and the like.

Machines of the type described above are generally quite complicated and are usually only found in health clubs, gymnasiums and the like. The disadvantage to the use of apparatus of this type is that usually a membership is required and the user is required to travel to the location of the health club or gymnasium to use the machines. This is sometimes inconvenient and the user often will have to wait to use the equipment and facilities and the user becomes quickly discouraged and the exercise program is quickly abandoned.

In view of the foregoing, there clearly exists a need for a personal universal exercise device that will provide both aerobic and weight training exercises and which will provide the user with all of the exercising variations required to develop the entire body and which device can be adapted for private or home use.

Accordingly, it is the object of the present invention to provide an improved exercising device capable of use for a substantial number of exercising functions.

As a further object, the present invention provides an exercising device that is easily adjustable to accomodate various exercises which can be conveniently and quickly disassembled and taken down for storage by the user.

Still another object of the present invention is to provide a device which will accomodate both weight training and aerobic exercises to fully condition the user to improve endurance, fitness and health.

Still another object of the present invention is to provide a universal type exercise device which can accomodate a number of accessories for providing a wide range of exercising capabilities.

Still another object of the present invention is to provide a highly efficient exercise device which utilizes an adjustable bracket or coupling in its construction to facilitate assembly and quick adjustment.

Briefly, the the preferred embodiment, the present invention includes an upright frame that rests on the floor. The frame includes tubular members that are secured together by a unique coupling. A pair of cables are secured to take-up reel on the frame. The cable terminates at hand-pulls and are attached at an intermediate location to a lift to which preselected weights can be attached. The cables may be variously positioned to accomodate a wide variety of different exercises. Auxiliary exercise devices such as a bicycling apparatus, weight bench and trampoline are usable with the exercise apparatus. The weight bench and bicycle use the coupling in assembly. The trampoline has a reinforced rubber mat secured to its frame by an elasticized cord.

These and other objects and advantages of the present invention will become more apparent from the following description, claims and drawings in which:

FIG. 8 is a top view of the frame;

FIG. 9 is a partial side view of the frame showing the pulley system;

Figure 1:
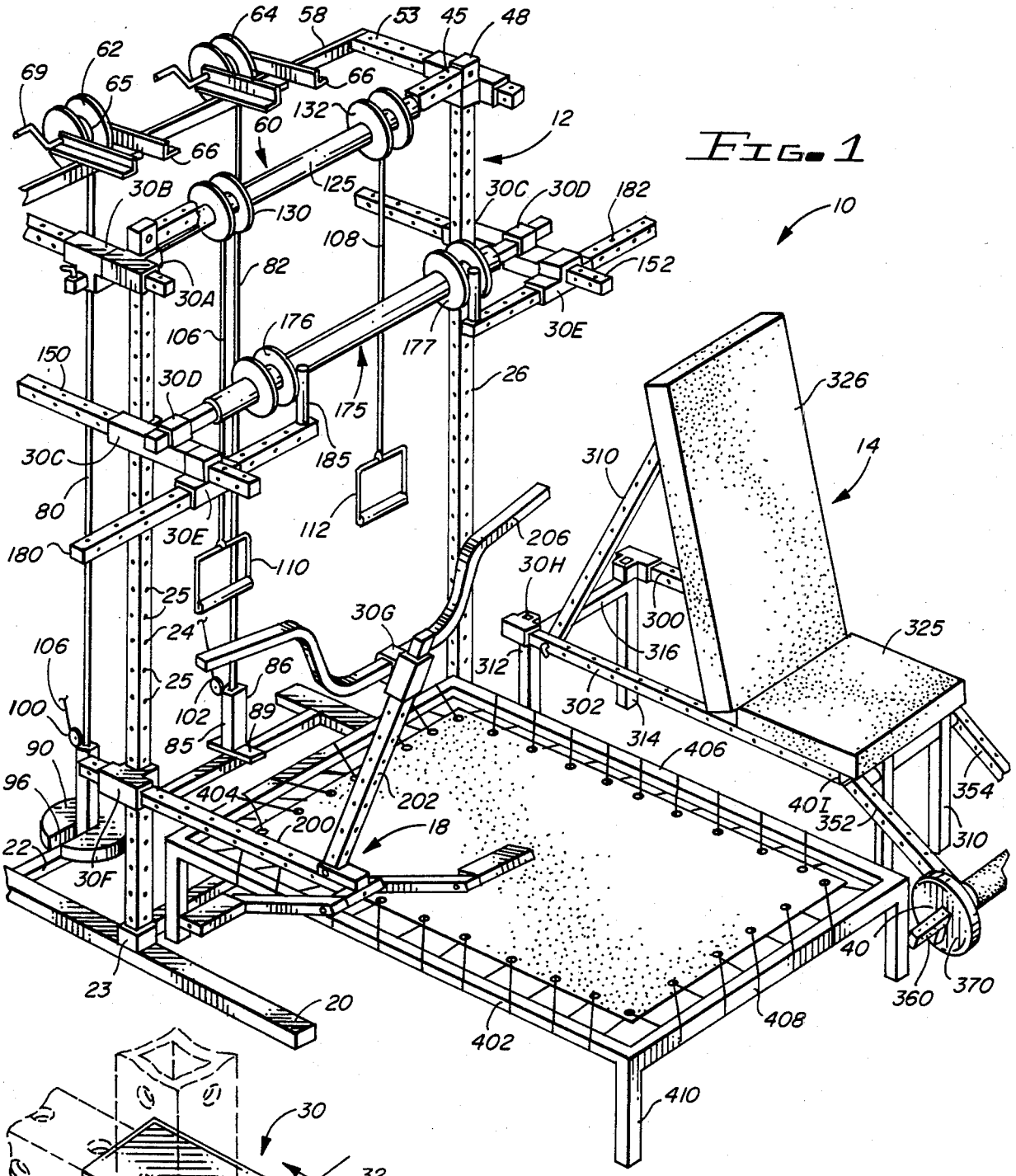
FIG. 1 is a perspective view of the exercise device of the present invention along with the various accessories or auxiliary devices associated therewith.

Turning now to the drawings, the exercise apparatus of the present invention is generally indicated by the numberal 10. It includes the unitary exercise device 12 and auxiliary devices such as the weight bench 14, trampoline 16 and bicycling machine 18.

The main apparatus is the unitary exercise machine 12 which consists of a base having a pair of parallel spaced apart pedestal support members 20 and transversely extending members 22. The side members 20 extend a sufficient distance to the front and rear of the frame to adequately support the device and prevent it from tipping while in use. Members 20 are preferably of tubing typically 1"×2".

The upstanding frame consists of vertical tubular members 24 and 26 attached at a socket 23 to support members 20 at their approximate mid-point. Members 24 and 26 are preferably tubular having a generally square cross-section and provided with a plurality of spaced apart holes 25 in each of the side faces of the tubular members as will be explained hereafter.

Figure 2:
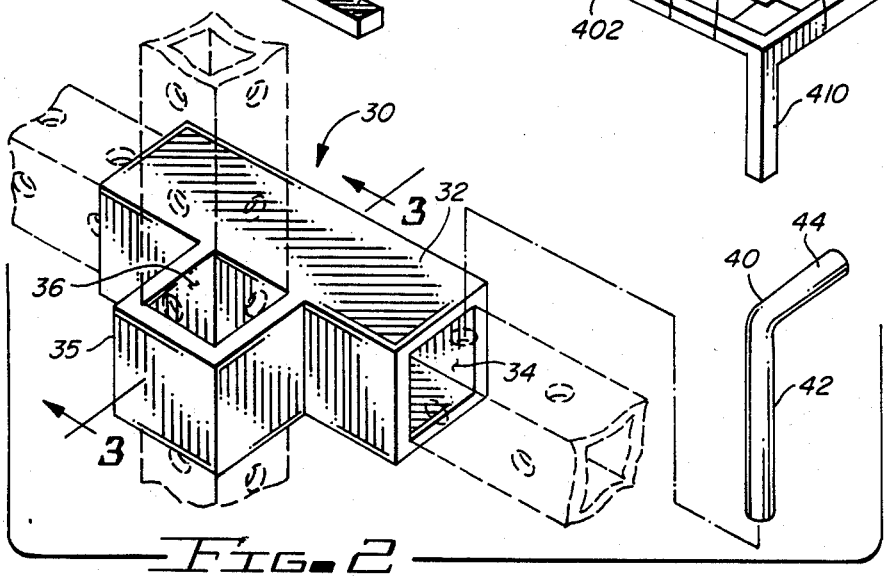
FIG. 2 is a detail perspective view of the bracket or coupling used in the construction of the device.
Figure 3:
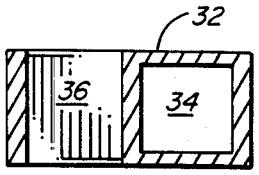
FIG. 3 is a sectional view taken along lines 3—3 of FIG. 2.

In order to accomodate easy and quick assembly and disassembly for storage or transportation, the exercise machine of the present invention is constructed using a universal bracket or coupling as best seen in FIGS. 2 and 3. The coupling 30 is an integral part of the construction of both the main exercise device and the accessories. Bracket 30 consists of a longitudinally extending channel member 32 having an opening 34 extending thereto to snugly receive tubular frame members such as members 25 and 26. A rectangular projection 35 is positioned at one side of channel 32 and defines opening 36 which is generally perpendicular to channel 34 and which is adapted to receive tubular frame members. Thus it will be apparent, as shown in dotted lines in FIG. 2, that tubular frame members can be adjustably positioned adjacent to one another and at right angles with respect to one another.

Couplings 30 are secured at the desired positions along the frame by pins 40 having a body or shank 42 which is of sufficient length to extend between holes 25 at opposite sides of the tubular frame member. Preferably, a handle portion 44 of the pin is formed at right angles with respect to the body to retain the pin in position and provide an area for the user to grasp when making adjustments.

As best seen in FIGS. 1 and 8, a coupling 30A is secured on each of the uprights 24 and 26. Couplings 30A are positioned with the upright extending through opening 36 so that the longitudinal opening 34 is horizontally disposed at the outside of the uprights 24 and 26. Upper horizontal frame members 52 and 53 are positioned in openings 34 at either side and extend rearward from the uprights. Note the terms "rear", "front" and "sides" are used for reference. For example, "front" generally refers to the portion of the apparatus immediately adjacent the trampoline as seen in FIG. 1. Note, the same reference numerals are used throughout to identify the same or similar elements with an appended letter being used to distinquish the location of such elements.

A pair of couplings 30B are positioned immediately adjacent couplings 30A at opposite sides of the exercise machine and are oriented so that their openings 36 will receive transversely extending spindle or shaft 60. Couplings 30A and 30B are held in place by appropriate pins 40 as explained above. Bar 45 extends between caps 48 positioned at the upper end of frame members 24 and 26. Bar 45 serves as a reinforcing or stiffening member.

The distal end of tubular frame members 52 and 53 are connected by transversely extending member 58 which is secured to members 52 and 53 by an appropriate mechanical fastener 51. A pair of take-up reels 62 and 64 are spaced apart along transverse member 58. The reels each consist of a spool member 65 which is rotatedly carried on pair of brackets 66 shown as angle irons welded or otherwise secured to crossmember 58. A handle 69 is provided for actuation of the spool 64 and the spool may be locked in any desired position by a detent mechanism as is well known.

Figure 12:
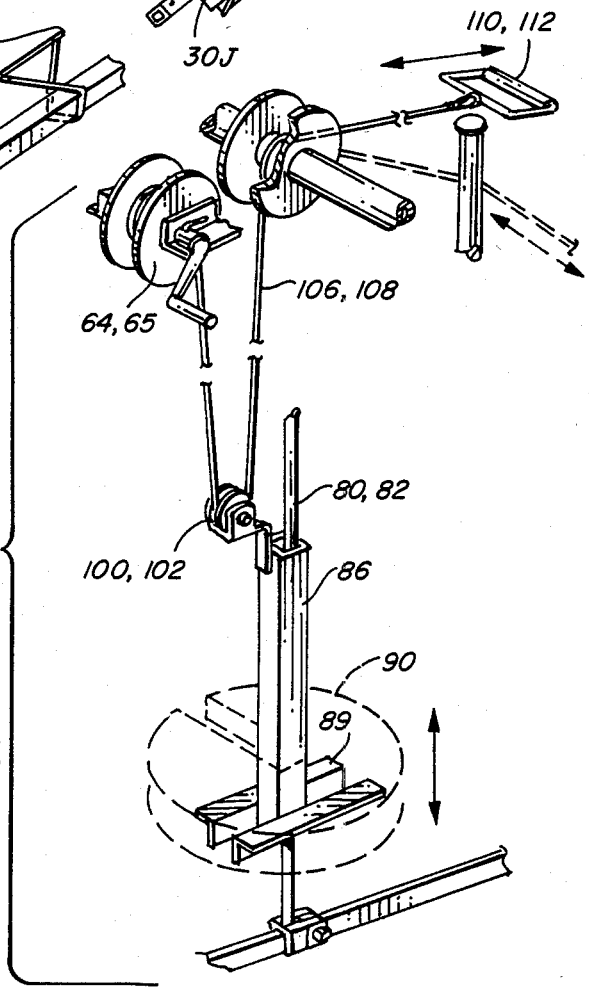
FIG. 12 is a detail view of the weight carrier.

A pair of vertical weight rods 80 and 82 depend from a location on crossmember 58 aligned with each of the reels 62 and 64 respectively and terminate at lower cross-member 22. A weight carrier or lift 85 having guide member 86 slidable along its respective rod 80 and 82 is provided. The carrier 85 is to accomodate a preselected number of individual weights which may be stacked on the weight carrier and supported on base 89 as best seen in FIG. 12.

Each of the individual weights consists of a generally disc-like body member 90 having a preselected weight. A radial slot 92 is provided in the disk so that the weight may be slipped about the vertical carrier 86 with its center of gravity approximately aligned with the weight rod. The selective weight feature is particularly desirable in a versatile exercise machine as proper accomplishment of the variety of exercises available with machine requires a wide range of weights be available. For example, leg lift exercises generally require only a part of lifting force or resistance force which over the head and arm exercises require.

A pulley 100, 102 is secured near the upper end of each of the carrier guide rods 86. A flexible cable terminates at each of the reels 62 and 64 and is designated by the numerals 106 and 108, respectively. Cable 106 is trained through lower pulley 100 with the other end terminating at a handle 110. Similarly, cable 108 extends from reel 64 through lower pulley 102 at the weight carriage and terminates at a handle 112.

Figure 7:
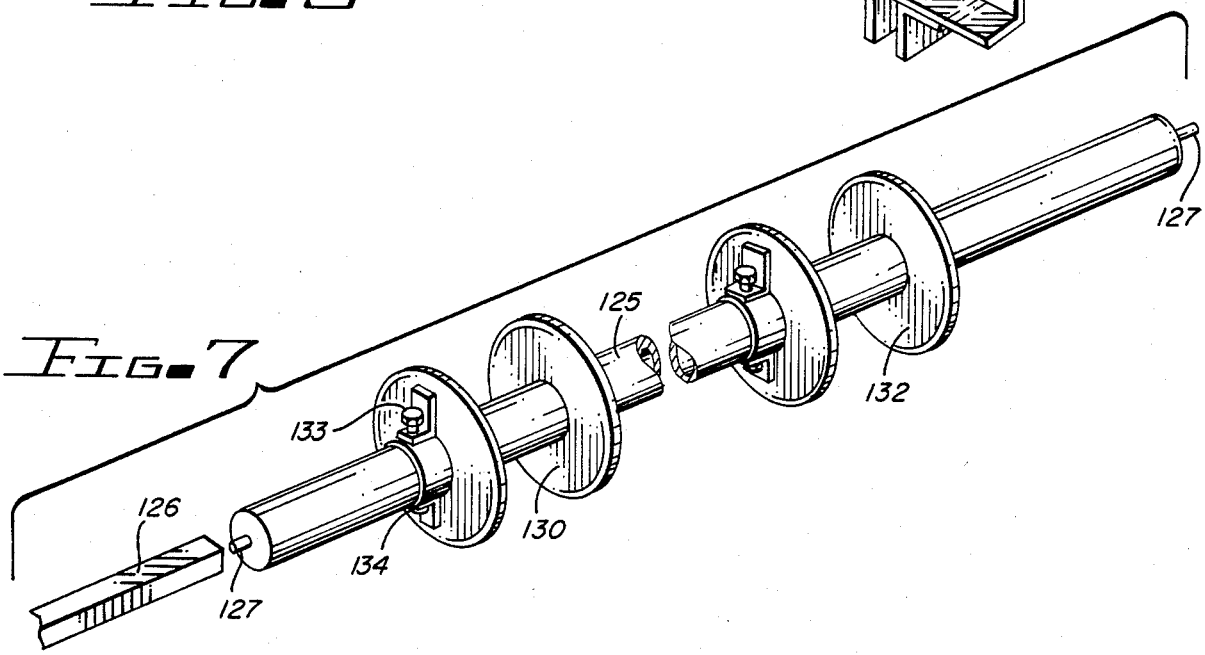
FIG. 7 is a perspective view of the cable take-up reel and shaft.

The above description relates to the unitary exercise machine in its simplest or elementary form. The location of other members will vary considerably with the particular exercise program the individual selects. FIG. 1 shows a typical arrangement. In this arrangement, an upper pulley shaft 60 extends between brackets 30B on frame members 52 and 53. The pulley shaft, as shown in detail in FIG. 7, consists of a central generally circular portion 125 and end sections 126 and 128. End sections 126 and 128 are generally square in cross section and are adapted to be received within the openings 36 in the brackets 30B at either side. The opposite ends of circular shaft section 125 have axial projections 127 which are received in bearings, not shown, in the ends of square shaft sections 126 and 128 so that the central section 125 may rotate relative to the end sections.

A pair of spools 130 and 132 are spaced apart on central section 125. The axial position of spools 130 and 132 along shaft portion 125 can be adjusted by loosening fastener 133 on collar 134 which allows the spools to slide axially. The position of the spools relative to shaft section 125 is determined by the exercise regimen selected by the user.

As best seen in FIG. 1, at an intermediate location along vertical members 25 and 26, pair of couplings 30C are oppositely disposed. Couplings 30C are positioned to support horizontally extending tubular frame members 150 and 152 and opposite sides of the device. A pair of couplings 30D are positioned on members 150 and 152, respectively with their associated projections 34 disposed to receive the ends of a second spool shaft 175. Spool shaft 175 is constructed similar to shaft 125 described above and further detailed description is not believed necessary. Shaft 175 carries a pair of individual spools 176 and 177 which are adjustably spaced apart along the center section of that shaft.

Couplings 30E are positioned near the front ends of members 150 and 152 so that tubular frame members 180 and 182 are transversely disposed in a horizontal position as best seen in FIG. 1. The inner ends of members 180 and 182 each carry a post member 185 which extends vertically. As has been pointed out above, the relative position of the takeup reels, spool shafts and other components varies considerably with the selected exercise and the physical characteristics of the individual. The construction of the device permits easy and convenient adjustment to meet these requirements.

At this point in the specification, a better understanding of the basic form of the exercise unit will be had from a description of a typical exercise program. With the basic device assembled as shown in FIG. 1 excluding the bicycle member 18, trampoline 16 and weight bench 14, a number of exercises can be accomplished. For example, if the user wishes to build the upper body arms and the like, suitable weights 90 are selected and placed on the weight carrier 85. The individual weights 90 can be added until the desired weight is achieved. The pulley cables 106 and 108 are adjusted to the desired length by rotating handle 69 of the takeup reels 64. The desired length is determined by the exercise to be performed, physical characteristics of the user and the distance the user wishes to position himself relative to the apparatus. Once this is established, the pulley cable 106 is trained over the upper reel 130 extending vertically downward beneath the lower cable reel 176. Cable 108 is similarly trained around reels 132 and 177. The user can then stand either facing the machine or facing away from the machine at the front side. Grasping the pulley handles 110, 112 various exercises such as curls and arm extensions, both forward and sideways, can be done to build various muscles of the upper body. The posts 185 allow the pulleys to be extended transversely of the machine as the cable will extend around the posts 185. As the user increases strength and endurance, various other exercise routines can be added as can additional weights.

Figure 5:
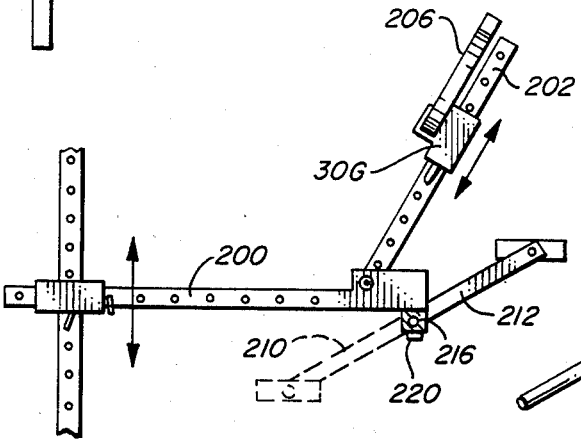
FIG. 5 is a partial detail view of the auxiliary bicycle device.
Figure 6:
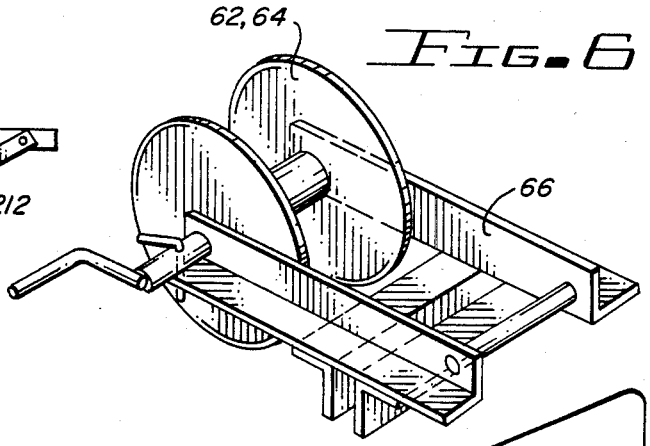
FIG. 6 is a detail perspective view of the cable adjusting reel.

If the user desires to engage in other exercises as for example bicycling, the bicycle attachment 18 can be added. The bicycle can be attached at universal coupling 30F as shown in FIGS. 1, 5 and 9. The bicycle assembly consists of a horizontally extending tubular frame member 200 to which attaches handlebar support member 202. Handlebar support member 202 is secured to member 200 at its lower end by welding or by an appropriate mechanical fastener. Member 202 is provided with a bracket 30G which is adjustable along the length of the member. Coupling 30G is positioned so that its projection 34 will support handlebar 206 in a generally horizontal position. Handlebar 206 is formed from a solid piece of tubular stock having a cross section adapted to be received within the opening 36 of the coupling 30G. The handlebar is curved so that it can be slidably removed from the coupling when necessary for disassembling. Locking pins 40 at either side of the coupling secure the handlebar in place.

The pedal assembly consists of two opposite crank members 210 and 212 having pedals 214 at their lower end. The upper members of the cranks are attached by a shaft 216 extending through the outer end of the horizontal member 200 in suitable bearings, not shown. In order to adjust the resistance to the pedal motion imposed by the user, adjusting member 220 may be tightened acting against the shaft bearing to increase the resistance to turning. It is noted that the position of the bicycle both vertically and with reference to the exercise machine may be conveniently adjusted at coupling 30F.

To use the auxiliary bicycle device 18, a seat such as weight bench 14 is pulled adjacent the bicycle. The user sits on the seat and grasping the bars engages in a pedalling motion. Thus the legs, particularly the quadriceps can be exercised. Further, this exercise is aerobic in nature to compliment the weight training activities described above which tend to develop strength and muscular endurance by having only a limited cardiovascular affect. When not in use, bicycle 18 can be quickly disconnected by removing the pins 40 and sliding member 200 from coupling 30F.

Figure 4:
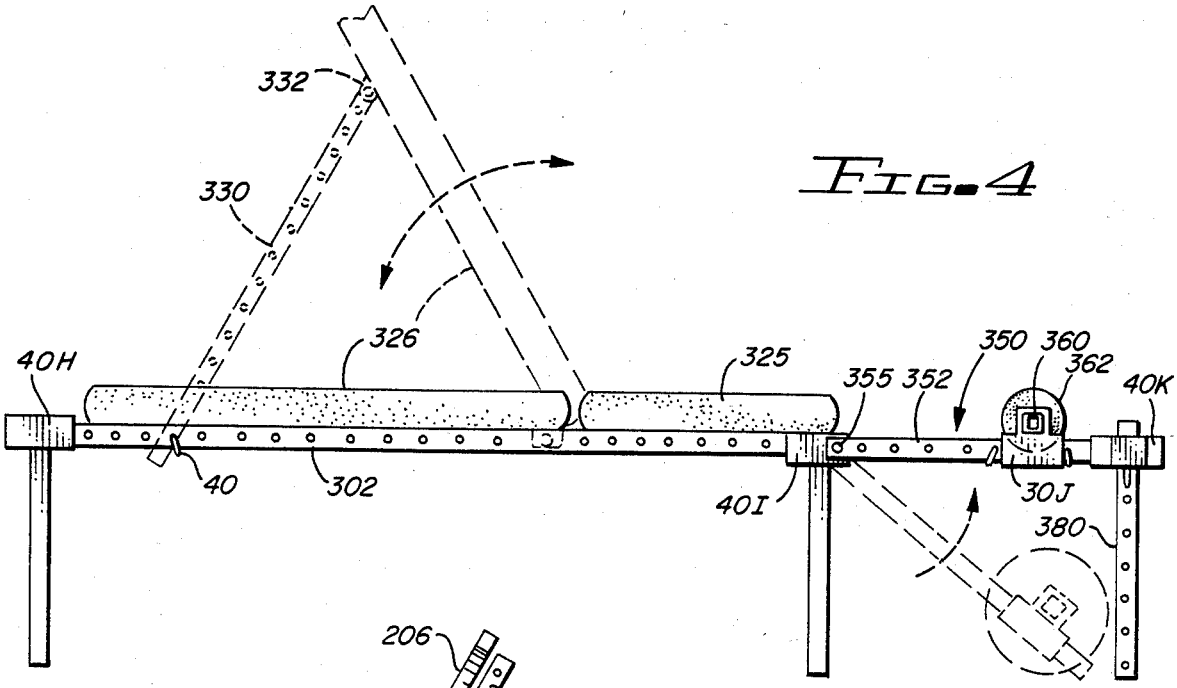
FIG. 4 is a side view of the auxiliary weight bench.
Figure 10:
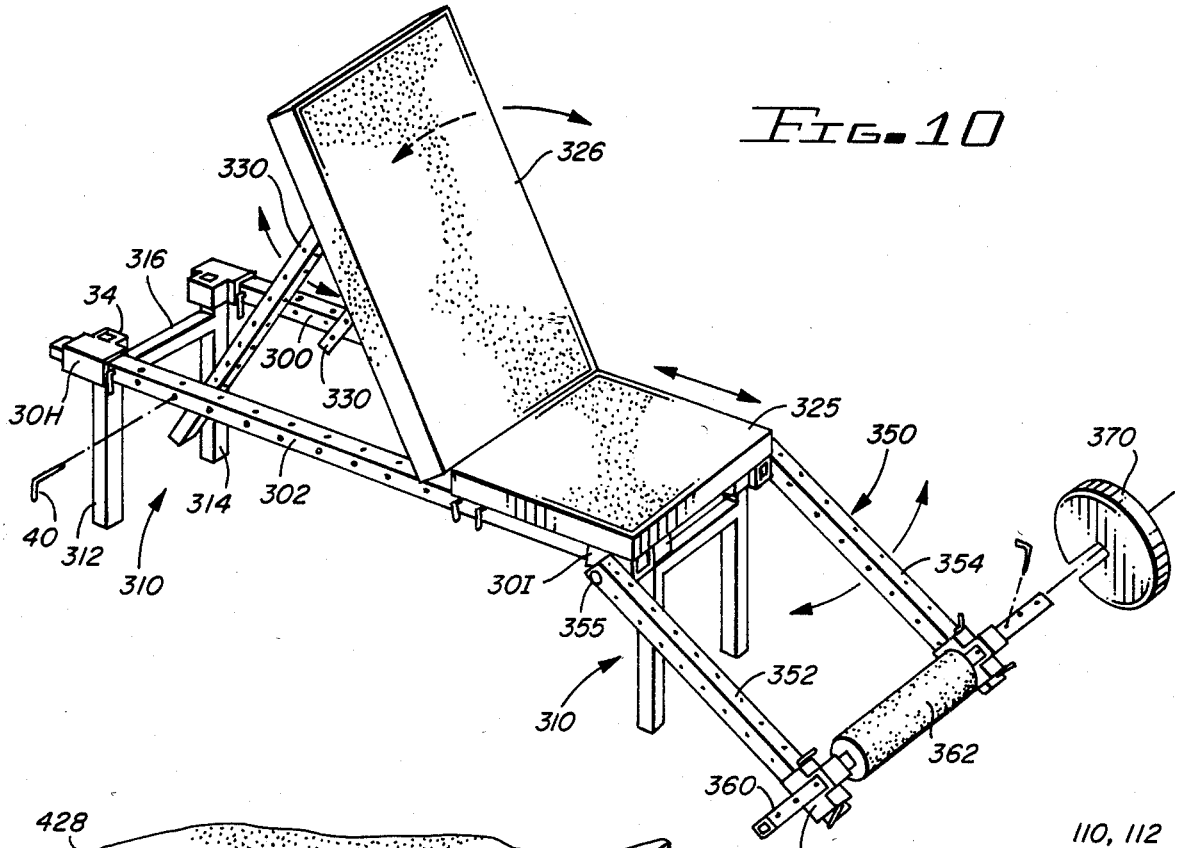
FIG. 10 is a perspective view of the weight bench.

The weight bench is best seen in FIGS. 1, 4 and 10 and including opposite, parallel tubular members 300 and 302. A pair of couplings 30H are positioned at the forward end of each of the members 300 and 302 with the projection 34 disposed vertically at inside of each of the members and adapted to receive the upward projection of the leg member 310. Leg member 310 consists of opposite legs 312, 314 and cross member 316 formed in a general "H". Similarly, a pair of couplings 30I are provided at the foot end of members 300 and 302 and receive and support leg member 310. As is conventional in weight benches, the padded seat 325 having back rest section 326 and seat portion 327 is provided. The back rest portion 326 is pivotal relative to the seat rest portion 325 and may be suspended at any desired position by the angular support 330 which is pivotally attached at clevis 332 at its upper at the back of section 326. The lower end can be secured to side member 300 by an appropriate pin 40 inserted through members 300, 330 and 302, 330.

Leg lift exercises may be accomodated by pivotal member 350 having opposite tubular side members 352 and 354. Coupling 30I has been drilled to have a crossbore to receive laterally or transversely extending shaft 355. A pair of couplings 30J are provided at a selected location along members 352 and 354 and support a crossbar 360. The central portion of crossbar 360 is padded at 362 and extends laterally of side members 352 and 354 to receive selected weight members 370 as may be desired. The weights may be secured in place by pins 40 extending through the apertures in the crossbar. The user may clamp or place desired number of weights on the weight bar place the front side of his feet against the bar and in a sitting position proceed to do leg lifts against the weight supported on crossbar.

The weight bench may also be used as a situp bench by moving members 352 and 354 to a horizontal position as seen in FIG. 4 and placing an additional pair of couplings 40K at their outer ends. The couplings 40K can be used to support spaced apart legs 380 which position the padded crossbar section 360 in a position of alignment with the weight surface. Thus the user can lie on his back and again engage his feet about the padded crossbar and proceed to do situps and other exercises. The bench may also be placed immediately in front of the main apparatus for bar bell exercise. The forwardly extending frame members 150, 152 will serve as a rack or rest to support the bar bell particularly when the user is engaged in bench press and similar exercises where a weight support is needed.

Figure 11:
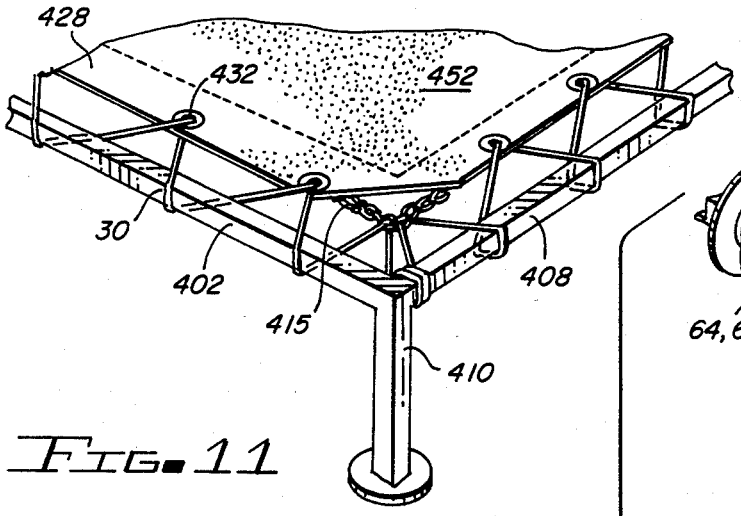
FIG. 11 is a detail view of the construction of the auxiliary trampoline.

Another unique accessory usable with the unitary exercise machine of the present invention is the trampoline best seen in FIGS. 1 and 11. The trampoline 16 is shown as being generally rectangular having a rigid generally rectangular frame comprised of opposite sides 402, 404, 406 and 408. The frame may be constructed of suitable material such as tubular steel and joined by welding. Legs 410 are provided at the intersection of the frame members. Each of the legs may be provided with a suitable foot to prevent damage to the surface.

Within the rectangular frame a flexible bed 425 such as woven plastic mesh is resiliently supported from side members 402, 404, 406 and 408. The woven plastic mesh bed is provided with a marginal edge 428 which is formed by turning the edge of the mat inward and stitching to form a marginal hem opening. A chain 415 extends around the periphery of the mat within the marginal hem opening.

The trampoline bed is yieldingly connected to the frame by a continuous section of elasticized cord 30 such as a bungee cord which extends around the peripheral frame elements and through perforations 432 in the edge of the mat and through individual links of the chain. The corner segments may be double wrapped as shown. It will be seen that the force imposed by a person jumping on the mat will tend to be uniformly distributed along the edges of the mat at the chain and imposed through the bungee cord on the frame. The trampoline may be used independently or in connection with the main apparatus.

Figure 13:
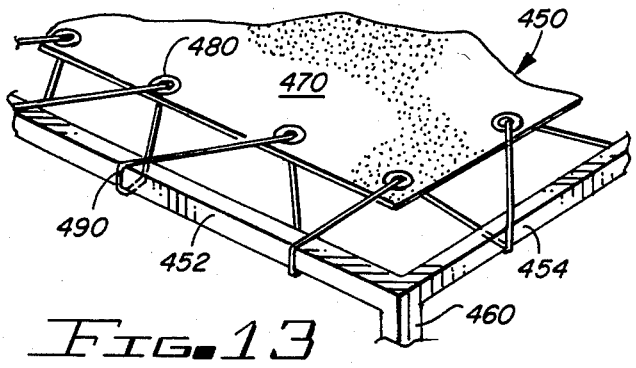
FIG. 13 is a detail view of an alternate construction of the trampoline.

FIG. 13 illustrates an alternate embodiment of the trampoline which is designated by the numeral 450. In this embodiment the rigid frame is comprised of side members 452 joined by welding. Legs 460 support the frame at a suitable elevation above the floor.

Mat 470 consists of a mesh nylon reinforced elastomeric material such as rubber. The peripheral edges of the mat at perforated spaced apart locations in which grommets 480 are placed. The mat is suspended in the frame by a continuous elasticized cord 490 wrapped about the side frame members and extending through the grommets. Again the trampoline will provide the necessary resilience and wear resistance.

From the foregoing, it will be appreciated that the present invention provides a compact, convenient and effective exercise system. It will be obvious to those skilled in the art to make various changes and modifications to the invention described herein. To the extent these changes and modifications do not depart from the spirit and scope of the appended claims, they are intended to be encompassed herein.

I claim:

1. A versatile adjustable universal exercise machine which uses detachable weights, said exercise machine comprising:

(a) a frame, a base supporting said, said frame having at least one upright frame member detachable from said base;

(b) at least one cable reel adjustably supported on said frame;

(c) a cable system including a flexible cable having a first end secured at said take-up reel and extendable about said one cable reel and having a handle at the other end for the user to grasp;

(d) a cable take-up reel means on said frame for varying the length of said flexible cable in accordance with the exercise to be performed with the flexible cable and which varies the position of the user relative to the frame;

(e) a guide rod supported on said frame; and (f) a weight lift slidable along said guide rod and attached to said cable by a pulley said lift permitting weight to be selectively positioned thereon to obtain a desired resistance force to extension of said cable at said handle.

2. The exercise device of claim 1 further including a second cable reel adjustably secured to said frame.

3. The exercise device of claim 2 wherein said first and second cable reels are carried on shafts connected by couplings at opposite ends to said frame.

4. The exercise device of claim 1 further including a bicycle member having a main support member, pedal and crank assembly on said support and a handle bar assembly, said main support being adjustably secured to said frame at coupling means.

5. The exercise device of claim 4 further including means for varying the pedal resistance force.

6. The exercise device of claim 1 further including a weight bench having a rectangular frame, legs detachably secured to said frame at coupling means, a bench pad having a seat and back portion, said back portion being angularly positionable with respect to said seat.

7. The exercise device of claim 6 further including a frame member pivotally secured to said main frame and including a cross-member adapted to detachably receive weights.

8. The exercise device of claim 7 wherein said cross member is detachably secured to said frame at coupling means.

9. The apparatus of claims 3, 4, 6 or 8 wherein said frame members are tubular and said coupling means include a first channel member defining a longitudinal opening to receive a frame member and a second generally perpendicular channel to receive a frame member.

10. The apparatus of claim 9 wherein said frame members are generally rectangular with spaced apart apertures adapted to receive locking pins at selected locations abutting the said coupling means to secure said coupling means in place along said frame members.

* * * * *